US006046528A

United States Patent [19]

LaForest et al.

[11] Patent Number: 6,046,528

[45] **Date of Patent: *Apr. 4, 2000**

[54] SELECTIVELY ACTUATABLE PIEZOELECTRIC IGNITION MECHANISM

[75] Inventors: Guy LaForest, Cascais, Portugal; Marcel Meury, Tarragona, Spain

[73] Assignee: BIC Corporation, Milford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/962,672

[22] Filed: Nov. 3, 1997

[51] Int. Cl.[7] ..... H01L 41/08

[52] U.S. Cl. ..... 310/339; 361/260

[58] Field of Search ..... 310/338, 339; 361/260; 431/255, 141, 143, 153

[56] References Cited

U.S. PATENT DOCUMENTS

| | | | |
|---|---|---|---|
| 3,428,408 | 2/1969 | Ameyama et al. | 310/339 X |
| 3,449,637 | 6/1969 | Suzuki | 310/339 X |
| 3,457,461 | 7/1969 | Steinke et al. | 317/81 |
| 3,466,474 | 9/1969 | Ochiai et al. | 310/339 |
| 3,475,654 | 10/1969 | Ochiai et al. | 310/339 X |
| 3,486,075 | 12/1969 | Steinke et al. | 317/81 |
| 3,509,388 | 4/1970 | Mifune et al. | 310/339 |
| 3,521,987 | 7/1970 | Goto | 431/255 |
| 3,576,471 | 4/1971 | Schumacher | 310/339 X |
| 3,729,639 | 4/1973 | Heinouchi et al. | 310/8.3 |
| 3,751,690 | 8/1973 | Okamoto | 310/339 |
| 3,800,171 | 3/1974 | Ishii et al. | 310/339 |
| 3,829,737 | 8/1974 | Johnsson | 317/81 |
| 3,866,069 | 2/1975 | Ishii et al. | 310/8.7 |
| 3,949,248 | 4/1976 | Duffner et al. | 310/8.7 |
| 3,984,738 | 10/1976 | Mohr | 371/81 |
| 4,015,152 | 3/1977 | Mohr | 310/8.7 |
| 4,139,792 | 2/1979 | Kondo | 310/339 |
| 4,315,180 | 2/1982 | Kondo et al. | 310/319 |
| 4,422,124 | 12/1983 | Challet | 361/260 |
| 4,608,508 | 8/1986 | Ohnishi | 310/339 |
| 4,786,248 | 11/1988 | Nitta | 431/255 |
| 4,859,172 | 8/1989 | Nitta | 431/153 |
| 4,904,180 | 2/1990 | Nitta | 431/153 |
| 5,059,852 | 10/1991 | Meury | 310/339 |
| 5,145,358 | 9/1992 | Shike et al. | 431/153 |
| 5,178,532 | 1/1993 | Frigiere | 431/254 |
| 5,228,849 | 7/1993 | Frigiere | 431/255 |
| 5,240,408 | 8/1993 | Kenjiro et al. | 431/153 |
| 5,262,697 | 11/1993 | Meury | 310/339 |
| 5,462,432 | 10/1995 | Kim | 431/153 |

FOREIGN PATENT DOCUMENTS

| | | |
|---|---|---|
| 0 172 973 | 3/1986 | European Pat. Off. . |
| 0 488 158 | 6/1993 | European Pat. Off. . |
| 0 689 011 | 12/1995 | European Pat. Off. . |
| 222927 | 12/1974 | France . |
| 8902741 | 2/1989 | Spain . |
| 2014189 | 6/1990 | Spain . |
| 2026089 | 4/1992 | Spain . |
| 2032187 | 1/1993 | Spain . |
| 2046964 | 2/1994 | Spain . |
| 1 218 207 | 1/1971 | United Kingdom . |
| 1415003 | 11/1975 | United Kingdom . |
| 2 072 820 | 10/1981 | United Kingdom . |

*Primary Examiner*—Mark O. Budd
*Attorney, Agent, or Firm*—Pennie & Edmonds LLP

[57] ABSTRACT

A piezoelectric mechanism is disclosed that is normally depressible but would not produce a spark, unless a latch member is first activated to engage the plexor relative to the piezoelectric system, so that when the piezoelectric mechanism is compressed, the plexor is released to impact the piezoelectric system to produce a spark to ignite fuel gas.

33 Claims, 8 Drawing Sheets

SELECTIVELY ACTUATABLE PIEZOELECTRIC IGNITION MECHANISM

BACKGROUND OF THE INVENTION

1. Technical Field

The present invention relates to a piezoelectric ignition mechanism for gas lighters, range tops, outdoor gas grills, or the likes, which comprises a device capable of selectively inhibiting the production of sparks by the piezoelectric ignition mechanism to resist undesired use of the lighter by young children.

2. Background Art

Recently, attention has been directed toward preventing ready actuation of cigarette lighters by persons normally not able to appreciate the potential danger of the flame. Such danger includes the potential to burn the individual directly or to burn surrounding areas or items. The individuals contemplated in these efforts are young children in the age category of under five years of age.

As known, piezoelectric mechanisms generally consist of a telescopic assembly comprising an upper member and a lower member, which are capable of moving relative to each other. The outer and inner members are normally kept at a predetermined distance from each other by a return spring. A crystal or piezoelectric element is normally embodied in the upper member of the telescopic assembly. An electrical spark is produced when a hammer or "plexor" impacts the piezoelectric element. The piezoelectric element, in turn, is placed between an "anvil" member, and the "impact pad", which actually receives the impact from the plexor.

The plexor is slideably disposed in the axial void of the telescopic assembly. In the rest position, the plexor is disposed at a predetermined distance away from the impact pad by means of a retaining mechanism. An impact spring is normally positioned between the plexor and the lower telescopic member to bias the plexor toward the impact pad.

To produce a spark, a manual compressive force is applied to the telescopic assembly causing the upper and lower members to move toward each other. This action also compresses the return spring which separates the upper and lower members, and simultaneously compresses the impact spring to store energy therein. Near the end of the contraction of the telescopic assembly, the plexor is released from the retaining mechanism and the compressed impact spring drives the plexor toward the impact pad, creating the impact energy to generate the electrical potential across the piezoelectric element. Said potential is conducted through other conductive elements in the cigarette lighter, which make up an electrical circuit. This circuit has an open gap located near the valve where the fuel from a fuel supply is released. Said potential creates a spark across the gap and ignites the released fuel to create a flame. An example of such piezoelectric mechanism is disclosed in U.S. Pat. No. 5,262,697 entitled "Piezoelectric Mechanism For Gas Lighters". The disclosure of the '697 is hereby incorporated by reference.

It is desirable to increase the difficulty of using lighters to limit the ability of young children under five years of age to operate such piezoelectric lighters. For this reason, there are attempts to provide "child-resistant" piezoelectric lighters offered in the patent literature. Examples of such patents include U.S. Pat. Nos. 5,145,358, 5,240,408, 4,904,180, 4,859,172, 4,786,248 and 5,228,849. Each of these disclosed devices has in common the fact that depression of the thumb pad, which compresses the telescopic assembly and activates the piezoelectric mechanism, is prevented by a latch member to inhibit the production of sparks. Normally, the latch member is disposed between the thumb pad and a wall of the lighter body. This latch member must be aligned or positioned precisely between the thumb pad and the wall of the lighter body in order to prevent the depression of the thumb pad.

Thus, there remains a need for a device, which increases the difficulty of operating a piezoelectric ignition mechanism and which would not require the precise alignment of the latch member in order to inhibit the production of spark.

SUMMARY OF THE INVENTION

Thus, it is an object of this invention to provide a lighter which presents a desirable level of difficulty of operation by unintended users.

Another object of the invention is to provide a piezoelectric ignition mechanism which does not require the precise alignment of a latch member between the thumb pad and the lighter body to present a desirable level of difficulty of operation of the ignition mechanism.

Another object of the invention is to provide a lighter having telescopic piezoelectric elements which have no appreciable relative motion with respect to each other unless a latch member is activated.

These and other objectives can be achieved by a piezoelectric ignition mechanism comprising a telescopic assembly having first and second members, a return spring for biasing the second member toward the first member, a piezoelectric element and its impact pad mounted in one of said members, and a plexor member movably disposed within the telescopic assembly and biased toward the piezoelectric element and its impact pad by an impact spring. In a rest configuration, the plexor is positioned in contact with the piezoelectric member and its impact pad such that when an external force is applied to the telescopic assembly both the piezoelectric element and the plexor are displaced together so that the plexor is inhibited from impacting the piezoelectric element and its impact pad.

The piezoelectric ignition mechanism further comprises a latch member actuatable by a user to displace the plexor to a predetermined distance away from the impact pad, so that when the external force, greater than a threshold amount, is applied to the telescopic assembly the plexor strikes the impact pad to excite the piezoelectric element causing it to produce a spark.

DESCRIPTION OF THE PREFERRED EMBODIMENTS

Figure 1:
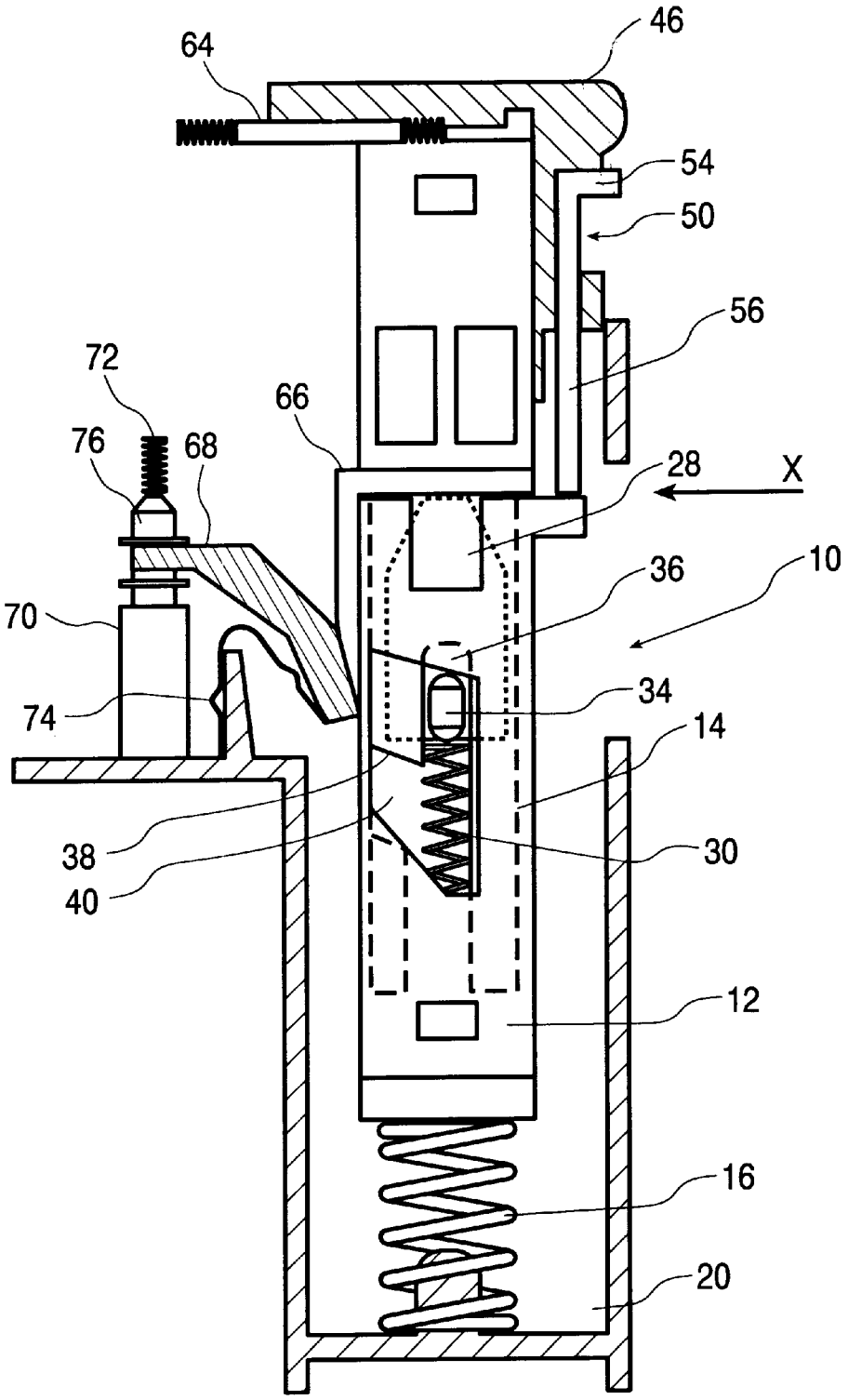
FIG. 1 is a front longitudinal view of the piezoelectric ignition mechanism according to the present invention in a rest configuration located in a gas lighter assembly.

Referring to the drawings, wherein like reference numbers are used to designate like parts, and as shown in FIG. 1, the piezoelectric ignition mechanism 10 of a lighter according to the present invention comprises an outer telescopic member 12, and an inner telescopic member 14. Unlike the telescopic assembly known in the prior art described above, e.g. '697 patent, in the present invention there is substantially little or no separation or space, as denoted by X, between the two telescopic members, in the rest or normal configuration. Return spring 16, which is disposed below outer member 12, resiliently biases the two telescopic members together. Piezoelectric mechanism 10 is disposed in a chamber 20 located on the body of a lighter, and is isolated from the fuel source, e.g., compressed hydrocarbon gas.

Figure 2:
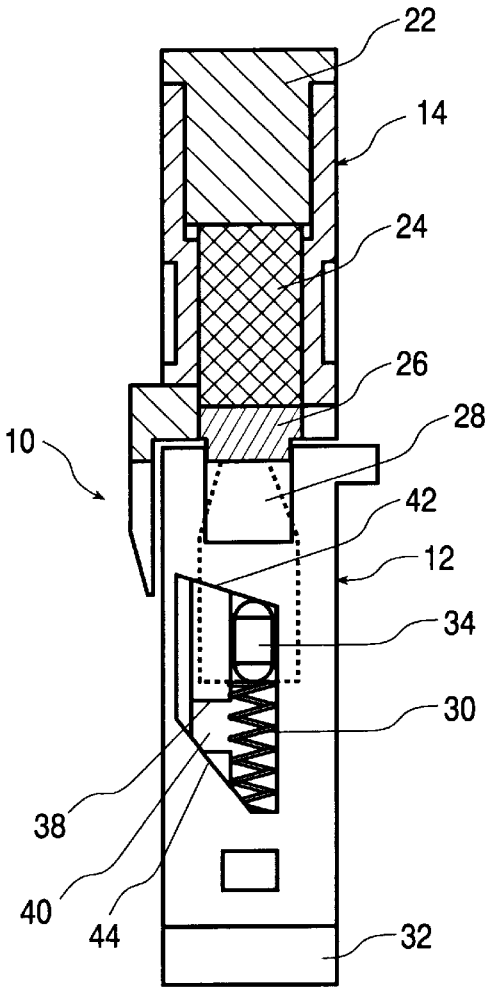
FIG. 2 is a partial cross sectional view of the piezoelectric ignition mechanism shown in FIG. 1.
Figure 4:
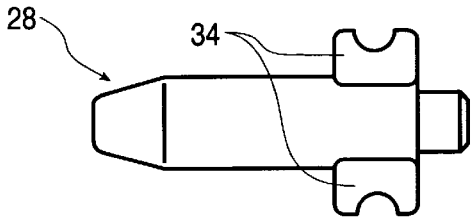
FIG. 4 is a front view of the plexor member.
Figure 5:
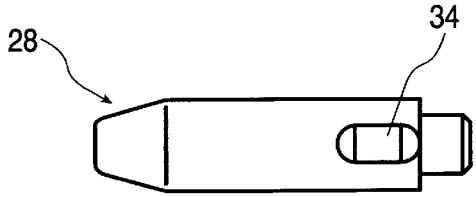
FIG. 5 is a side view of the plexor member.

As shown in FIG. 2, piezoelectric mechanism 10 comprises anvil member 22, piezoelectric element 24, and impact pad 26. Plexor member 28, shown in phantom in FIG. 2 and also in FIGS. 4 and 5, is guided within inner telescopic member 14 and adjacent to impact pad 26. Plexor 28 is resiliently biased against impact pad 26 by impact spring 30. Spring 30 is also disposed in inner member 14, and is supported on one end by bottom member 32 of outer member 12.

Figure 3:
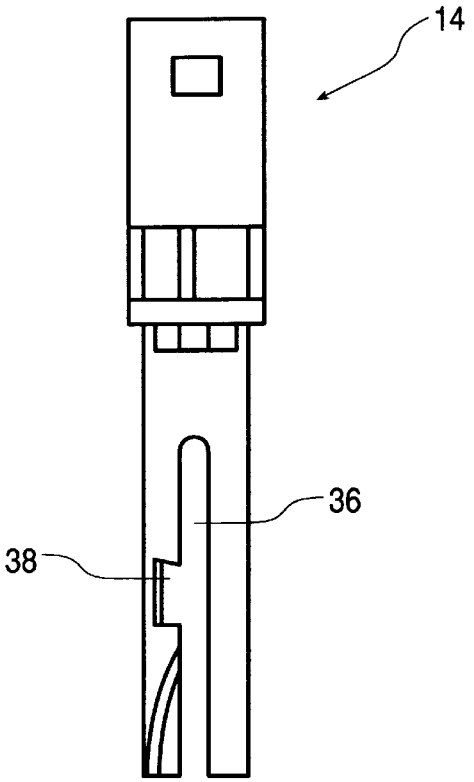
FIG. 3 is a front view of an inner telescopic member of the piezoelectric ignition mechanism shown in FIG. 1.

Plexor 28 has two lugs 34 disposed on opposite sides thereof. Lugs 34 are received in longitudinal slots 36, which are defined on opposite sides of inner member 14 as shown in FIG. 3. Longitudinal slots 36 guide the travel of plexor 28, limiting it to the longitudinal direction. Each longitudinal slot 36 also has retaining notch 38, whose functions will be described below. In the rest position shown in FIG. 1, lugs 34 are disposed at or near the upper end of slots 36.

Figure 6:
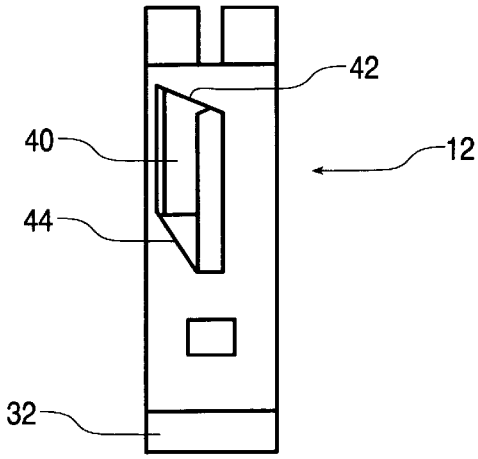
FIG. 6 is a front view of an outer telescopic member of the piezoelectric ignition mechanism show in FIG. 1.

Lugs 34 are configured and dimensioned to protrude beyond slots 36, and into windows 40, which are defined on opposite sides of outer member 12 as shown in FIGS. 1, 2 and particularly in FIG. 6. Window 40 also has upper ramp surface 42 and lower ramp surface 44.

Figure 7:
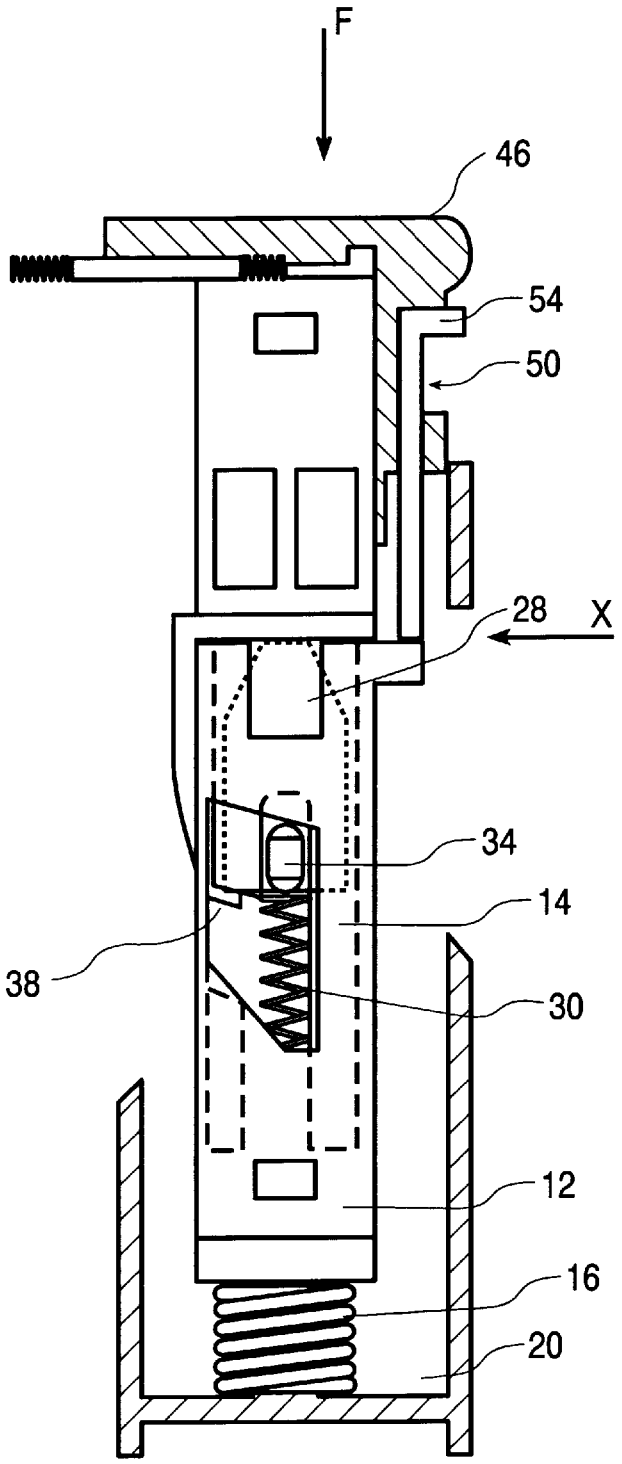
FIG. 7 is a front view of the piezoelectric ignition mechanism in a depressed configuration when the latch is unengaged.

From the rest or normal position, if an external force F is applied to thumb pad 46, both outer and inner telescopic members are simultaneously depressed as depicted in FIGS. 1 and 7. Since members 12 and 14 are in contact to each other, there can be no relative movement between members 12 and 14. Return spring 16 is also compressed, so that when force F is released spring 16 resiliently pushes the telescopic assembly upward back to the configuration of FIG. 1. Furthermore, since piezoelectric element 24 and impact pad 26 are embedded in inner telescopic member 14 and plexor is biased against impact pad 26, there is also no relative movement between plexor 28 and impact pad 26, and impact spring 30 is not being compressed. Thus, no impact force between said plexor and impact pad can be generated and no spark is produced. This feature of the present invention allows an unintended user to produce movement from thumb pad 46, but would not allow the unintended user to produce a spark.

Figure 8:
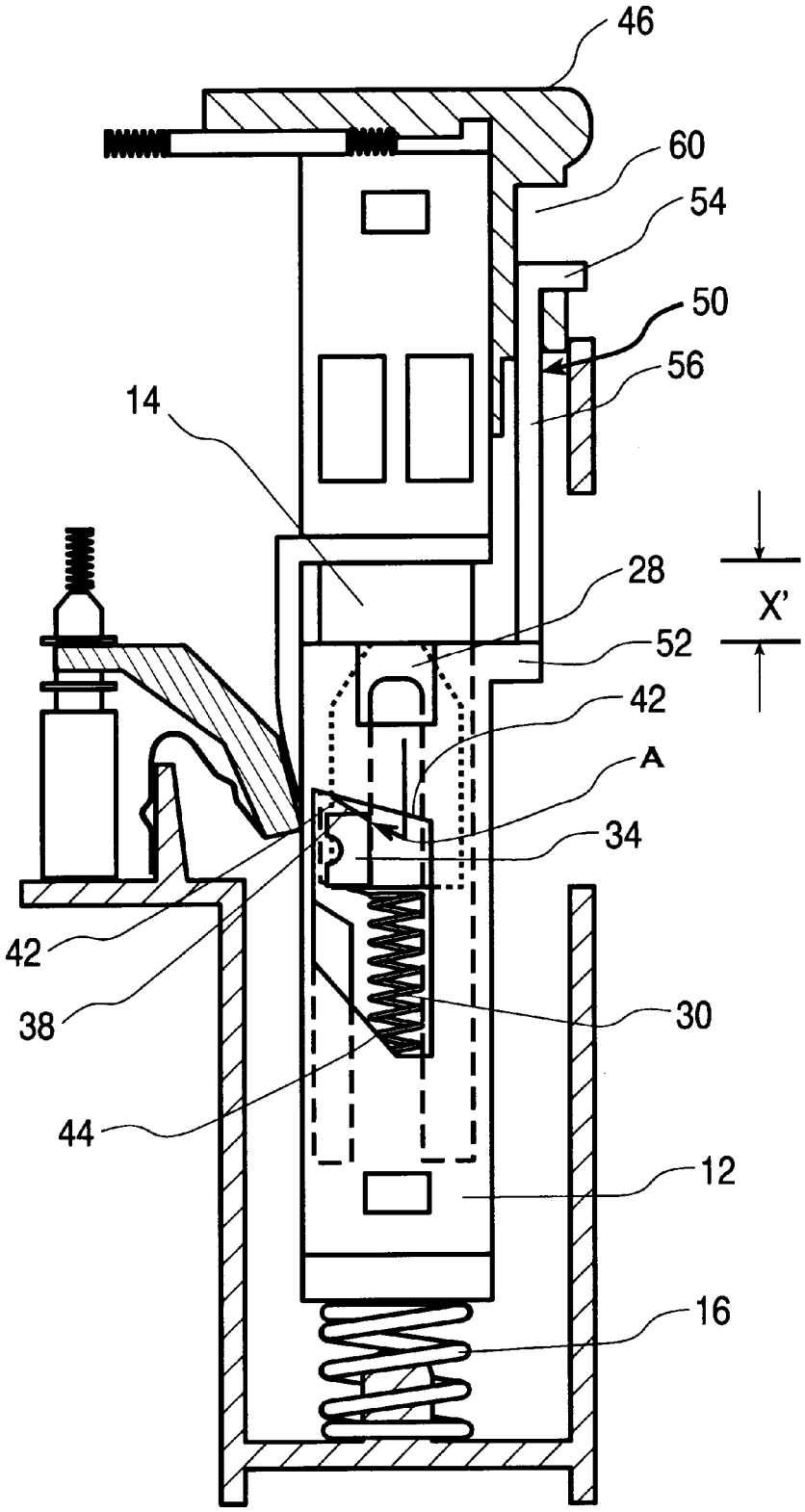
FIG. 8 is a front view of the piezoelectric ignition mechanism similar to that of FIG. 1 but with the latch member engaged.

To produce a spark, the intended user first displaces plexor 28 away from impact pad 26 prior to the application of external force F. As shown in FIG. 8, this can be accomplished by manually moving plexor 28 downward and retaining it at a predetermined position away from the piezoelectric element. When latch member 50, which is located near thumb pad 46, is pressed downward, it comes into contact with ledge member 52 of outer telescopic member 12 and pushes member 12 downward, and partially compresses return spring 16 and impact spring 30, as shown in FIG. 8. As outer telescopic member 12 is moved downward, ramp surfaces 42 of windows 40 push lugs 34 downward along longitudinal slots 36. When ramp surfaces 42 align with retaining slots 38, impact spring 30 resiliently pushes lugs 34 along the ramp surfaces 42 and deposits lugs 34 into retaining notches 38, thereby retaining plexor 28 at a position away from impact pad 26. The displacement of lugs 34 is shown by the arrow "A" in FIG. 8. At this point, the top of plexor 28 is located at a predetermined distance X' away from impact pad 26.

Figure 9:
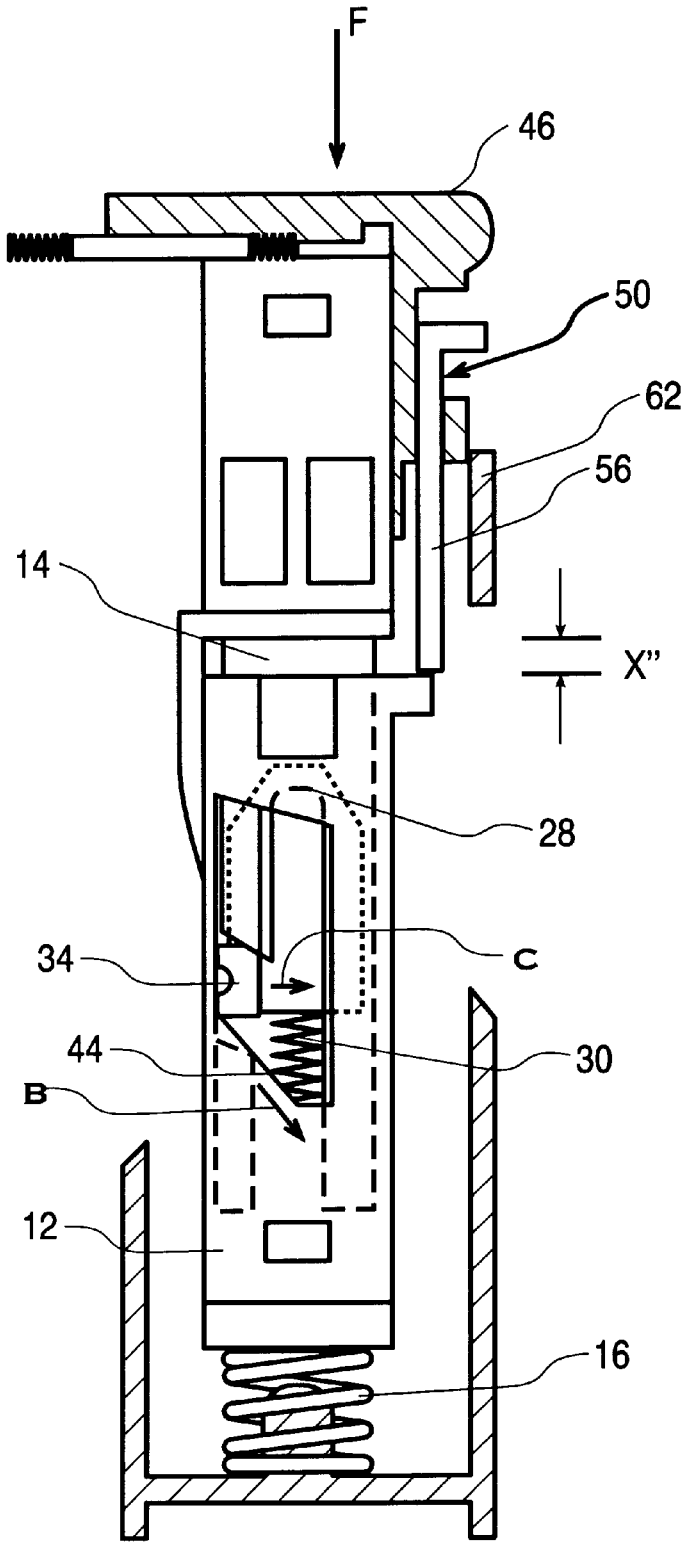
FIG. 9 is a front view of the piezoelectric mechanism of FIG. 8 in a partially depressed configuration.
Figure 10:
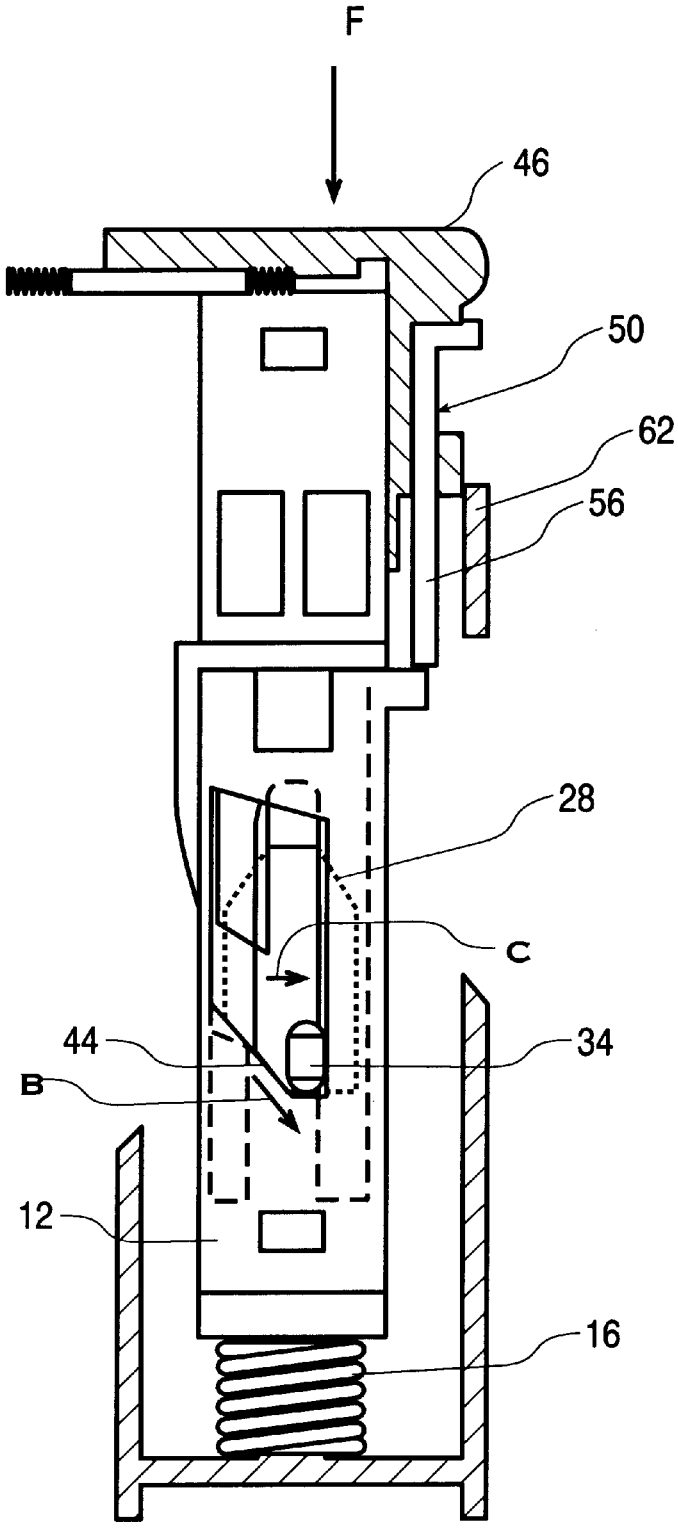
FIG. 10 is a front view of the piezoelectric mechanism of FIG. 8 in a fully depressed configuration before the plexor strikes the impact pad.
Figure 11:
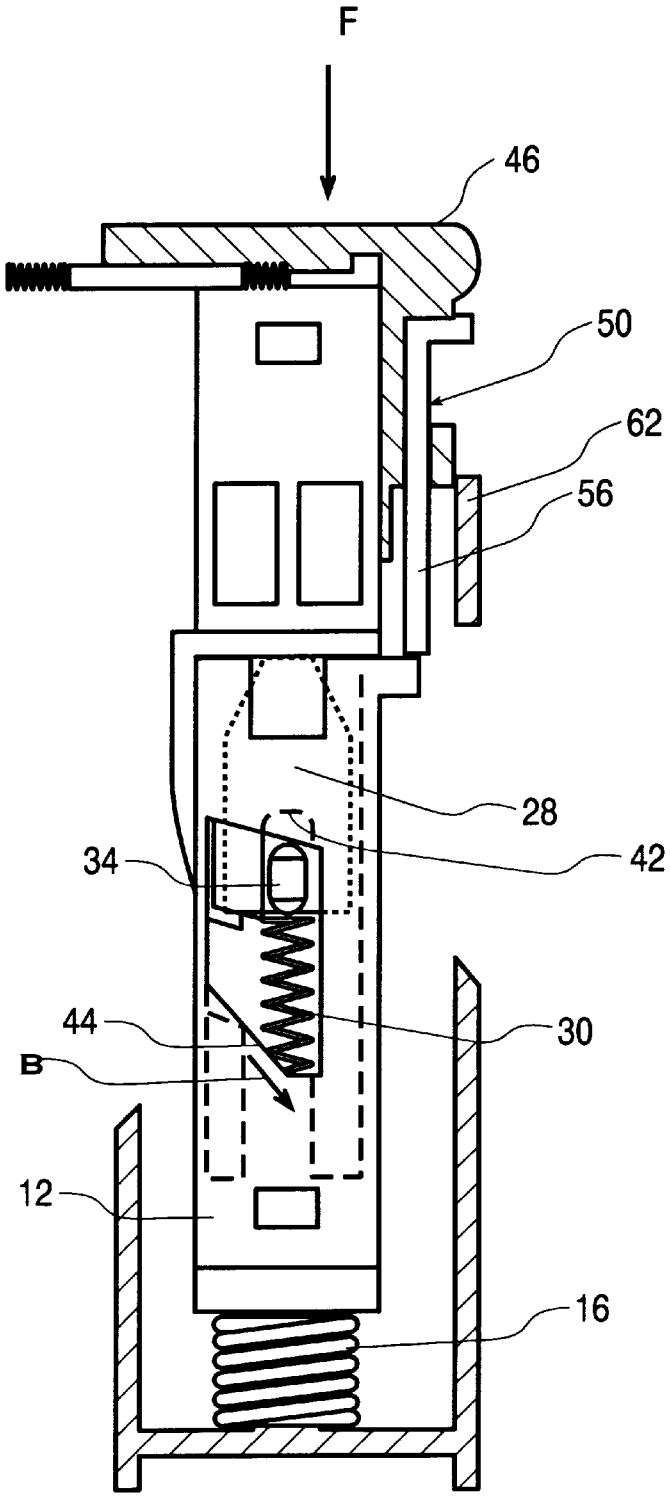
FIG. 11 is a front view of the piezoelectric mechanism of FIG. 8 in a fully depressed configuration after the plexor strikes the impact pad.

As depicted in FIGS. 8 and 9, when piezoelectric mechanism is in this configuration and external force F is applied to thumb pad 46 it pushes inner telescopic member 14 downward. Since there is now separation between members 12 and 14, inner member 14 moves downward into outer member 12, and pushes plexor 28, which is being held in notches 38 of inner member 14, downward and further compresses impact spring 30, until lugs 34 reaches ramp surfaces 44 on windows 40 of outer telescopic member 12. Lugs 34 then ride along ramp surfaces 44 generally in a downward direction as shown by arrow "B" and impact spring 30 is being further compressed as shown in FIGS. 9 and 10. As lugs 34 ride down ramps 44, they are displaced from retaining notches 38 and are once again aligned with longitudinal slots 36 as shown by arrow "C", and depicted in FIG. 10. At this point, impact spring 30 is fully compressed. After lugs 34 are free from notches 38, compressed impact spring 30 drives plexor 28 upward along longitudinal slots 36 to strike impact pad 26 and piezoelectric element 24 to produce a spark as shown in FIG. 11. When force F is released, return spring 16 pushes the entire piezoelectric mechanism 10 including latch member 50 upward to the rest configuration shown in FIG. 1.

Figure 12:
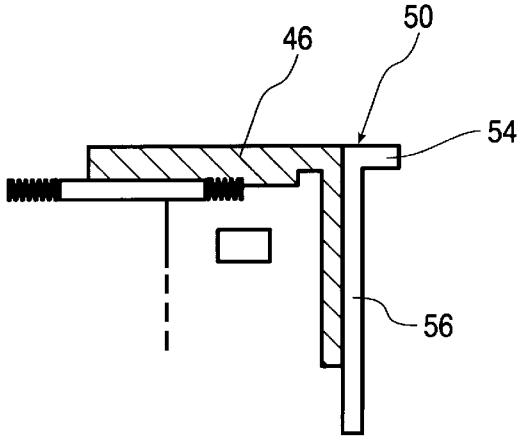
FIG. 12 is a top view of an alternative embodiment of the latch member.

Latch member 50 may have any configuration as long as it is capable of displacing outer telescopic member 12 away from inner telescopic member 14, and plexor 28 away from impact pad 26. Latch member 50 may be made out of any material, so long as latch member 50 has sufficient stiffness to displace the telescopic members away from each other. An example of latch member 50 is shown in FIGS. 1 and 7–9. As shown, latch 50 has a finger actuatable portion 54 and elongated body 56. It is slideably disposed within channel 60, a portion thereof is depicted in FIG. 8, defined in thumb pad 46, and movable up and down in the longitudinal direction. Channel 60 may also be defined in lighter body or the wall of chamber 20. Latch 50 can also be disposed in the space between thumb pad 46 and the outer wall 62 of the lighter body. As stated above, after being displaced downward, latch member 50 is returned to its at rest or normal configuration when return spring 16 returns outer member 12 and thereby ledge member 52 to its rest configuration, after ignition. Another embodiment of latch 50 is shown in FIG. 12, where the top of latch member 50 is positioned near the same level as the top of the thumb pad. Additionally, latch member 50 may also be resiliently biased such that it automatically returns to its at rest position after the plexor is displaced from the impact pad.

Referring to FIGS. 1, 2 and 8, after plexor 28 strikes impact pad 26 and piezoelectric element 24, an electrical potential difference is created across piezoelectric element 24. Piezoelectric member 24 is one element in an electrical circuit comprising first electrode 64, anvil 22, piezoelectric member 24, impact pad 26, cam member 66, valve actuator 68, valve system 70 and second electrode 72. Thus, the potential difference across piezoelectric element 24 is conducted through this circuit, and creates substantially the same potential difference between first electrode 64 and second electrode 72. This potential difference is sufficient to discharge a spark across the air gap between the two electrodes. In other words, the two electrodes act similar to a capacitor with air dielectric disposed therebetween. Any electrically conductive material may be utilized to make the components of this circuit. A person of ordinary skill in the art may select suitable materials for the various components in this circuit.

When thumb pad 46 is depressed to create the spark, cam member 66 is also depressed, and acts on valve actuator 68. Actuator 68 is pivoted such that when cam member 66 pushes one end of actuator downward, the other end is moved upward thereby lifting valve system 70 to release fuel gas. The released gas is then ignited by the spark discharged between electrodes 64 and 72.

Valve system 70 controls the release of fuel from the fuel supply. In a preferred embodiment as shown generally in FIG. 1, the fuel supply is compressed gas and valve system 70 is a normally open valve, forced closed by the pressure of a spring member 74. In this embodiment, valve actuator 68 acts on valve system 70 to lift valve stem 76 upward to release the compressed hydrocarbon gas.

In another embodiment, a normally closed valve, forced closed by an internal spring can be used with a valve actuator which exerts an upward pressure on valve system 70 to open the valve.

To operate the lighter, the user first depresses latch member 50 to separate telescopic member 14 from telescopic member 12, and simultaneously displace plexor 28 away from piezoelectric member 24 and impact pad 26. The user then depresses thumb pad 46, which causes cam member 66 to engage valve actuator 68 to lift valve stem 76 to release fuel gas. The depression of thumb pad 46 also causes plexor 28 to be released from the retaining mechanism thereby allowing compressed spring 30 to drive plexor 28 against impact pad 26 and causing piezoelectric element 24 to produce a spark to ignite the released fuel to produce a flame. To extinguish the flame, the user simply releases thumb pad 46 thereby releasing valve actuator 68 allowing spring 74 to close valve system 70. Spring 16 returns the piezoelectric ignition mechanism 10 to its rest or normal configuration as shown in FIG. 11.

The piezoelectric ignition mechanism of the present invention may also used with a natural gas oven range, an outdoor gas grill or similar devices to discourage undesirable usage.

While various descriptions of the present invention were described above, it is understood that the various features of the present invention can be used singly or in any combination thereof. Therefore, this invention is not to be limited to only the specifically preferred embodiments depicted therein.

What is claimed is:

1. A piezoelectric ignition mechanism comprising:

a telescopic assembly having first and second members and actuatable by a push button;

a piezoelectric element fixedly positioned in the telescopic assembly;

a plexor member movably disposed within the telescopic assembly, wherein an impact spring biases the plexor toward the piezoelectric element; and a latching member actuatable by a user to displace the plexor away from the piezoelectric element, such that when the plexor is positioned away from the piezoelectric element and the push button is actuated to compress the telescopic assembly, the plexor is released and driven by the impact spring to strike the piezoelectric element to generate a spark.

2. The piezoelectric ignition mechanism according to claim 1 further comprises a retainer, such that when the plexor is displaced to a predetermined distance from the piezoelectric element, it is retained by said retainer.

3. The piezoelectric ignition mechanism according to claim 2 wherein the piezoelectric element is disposed in the first member of the telescopic assembly and has an impact pad disposed between the plexor and itself, and wherein the plexor comprises at least one lug disposed on its side, said at least one lug is received by at least one longitudinal slot defined on the first member, so that the movement of the plexor is guided by said at least one longitudinal slot.

4. The piezoelectric ignition mechanism according to claim 3 wherein the retainer comprises at least one notch defined on the first member, such that when the at least one lug is received in the at least one notch the plexor is positioned at said predetermined distance from the piezoelectric element.

5. The piezoelectric ignition mechanism according to claim 4 wherein when the latch is actuated, the second member is also displaced from the first member.

6. The piezoelectric ignition mechanism according to claim 5 wherein the second member defines at least one first ramp so that when the second member is displaced, it displaces the plexor until the at least one first ramp aligns with the at least one notch so that the at least one lug is guided by the first ramp into the at least one notch.

7. The piezoelectric ignition mechanism according to claim 6 wherein the telescopic assembly is compressed when the first member moves toward the second member.

8. The piezoelectric ignition mechanism according to claim 7 wherein the second member defines at least one second ramp, so that when the first member is moved toward the second member, the at least one lug rides on the second ramp until the plexor is released from the at least one notch.

9. A piezoelectric ignition mechanism comprising:

a telescopic assembly having first and second members;

a piezoelectric system fixedly positioned in the telescopic assembly;

a plexor member movably disposed within the telescopic assembly, wherein an impact spring biases the plexor toward the piezoelectric system; and means for selectively displacing the plexor away from the piezoelectric system, such that when the plexor is positioned away from the piezoelectric system and the telescopic assembly is compressed, the plexor is released and driven by the impact spring to strike the piezoelectric system to generate a spark.

10. The piezoelectric ignition mechanism according to 9 wherein the displacing means comprises a latch actuatable by a user to displace the plexor away from the piezoelectric system, and a retainer disposed on the telescopic assembly adapted for holding the plexor at a predetermined distance from the piezoelectric system.

11. A piezoelectric ignition mechanism comprising:

a telescopic assembly having first and second members actuatable by a push button;

a return spring for biasing the second member toward the first member;

a piezoelectric system mounted in one of said members; and a plexor member movably disposed within the telescopic assembly and biased toward the piezoelectric system by an impact spring;

wherein in a rest configuration the plexor is positioned in contact with the piezoelectric system such that when an external force is applied to the push button to compress the telescopic assembly, both the piezoelectric system and the plexor are displaced together so that the plexor is inhibited from impacting the piezoelectric system; and wherein the piezoelectric ignition mechanism further comprises a latch member actuatable by a user to displace the plexor to a predetermined distance away from the piezoelectric system, so that when the external force is subsequently applied to the push button to compress the telescopic assembly the plexor impacts the piezoelectric system to produce a spark.

12. The piezoelectric ignition mechanism according to claim 11 further comprises a retaining mechanism, so that when the plexor is displaced to said predetermined distance, it is retained by said retaining mechanism.

13. The piezoelectric ignition mechanism according to claim 12 wherein the piezoelectric system is disposed in the first member of the telescopic assembly, and wherein the plexor comprises at least one lug disposed on its side, said at least one lug is received by at least one longitudinal slot defined on the first member, so that the movement of the plexor is guided by said at least one longitudinal slot.

14. The piezoelectric ignition mechanism according to claim 13 wherein the retaining mechanism comprises at least one notch defined on the first member, such that when the at least one lug is received in the at least one notch the plexor is positioned at said predetermined distance from the piezoelectric element.

15. The piezoelectric ignition mechanism according to claim 14 wherein when the latch is actuated the second member is also displaced from the first member.

16. The piezoelectric ignition mechanism according to claim 15 wherein the second member defines at least one first ramp so that when the second member is displaced, it displaces the plexor until the at least one first ramp aligns with the at least one notch so that the at least one lug is guided by the first ramp into the at least one notch.

17. The piezoelectric ignition mechanism according to claim 16 wherein the applied force moves the first member toward the second member.

18. The piezoelectric ignition mechanism according to claim 17 wherein the second member defines at least one second ramp, so that when the first member is moved toward the second member, the at least one lug rides on the second ramp until the plexor is released from the at least one notch.

19. The piezoelectric ignition mechanism according to claim 18 further comprises an impact pad disposed between the piezoelectric system and the plexor.

20. The piezoelectric ignition mechanism according to claim 19 further comprises an anvil member and two electrodes, said electrodes define a gap therebetween, such that the spark generated by the impact between the plexor and the piezoelectric system is conducted to the electrodes and discharged from one electrode to the other.

21. The piezoelectric ignition mechanism according to claim 11 wherein the latch member is received in a channel defined in a push-button where the external force is applied.

22. A lighter comprising:

a lighter body containing a fuel reservoir with a valve for releasing fuel therefrom;

a valve actuator depressible to actuate said valve to release said fuel; and a piezoelectric ignition mechanism comprising a telescopic assembly having first and second members actuatable by a push button, a return spring for biasing the second member toward the first member, a piezoelectric element mounted in one of said members; and a plexor member movably disposed within the telescopic assembly, and is biased toward the piezoelectric system by an impact spring;

wherein in a rest configuration the plexor is positioned in contact with the piezoelectric member such that when an external force is applied to the push button to compress the telescopic assembly, both the piezoelectric system and the plexor are displaced together so that the plexor is inhibited from impacting the piezoelectric system; and wherein the piezoelectric ignition mechanism further comprises a latch member actuatable by a user to displace the plexor to a predetermined distance away from the piezoelectric system, so that when the external force is subsequently applied to the push button to compress the telescopic assembly the plexor impacts the piezoelectric system to produce a spark.

23. The lighter according to claim 22 further comprises a retaining mechanism, so that when the plexor is displaced to said predetermined distance, it is retained by said retaining mechanism.

24. The lighter according to claim 23 wherein the piezoelectric element is disposed in the first member of the telescopic assembly, and wherein the plexor comprises at least one lug disposed on its side, said at least one lug is received by at least one longitudinal slot defined on the first member, so that the movement of the plexor is guided by said at least one longitudinal slot.

25. The lighter according to claim 24 wherein the retaining mechanism comprises at least one notch defined on the first member, such that when the at least one lug is received in the at least one notch the plexor is positioned at said predetermined distance from the piezoelectric element.

26. The lighter according to claim 25 wherein when the latch is actuated the second member is also displaced from the first member, and wherein the second member defines at least one first ramp so that when the second member is displaced, it displaces the plexor until the at least one first ramp aligns with the at least one notch so that the at least one lug is guided by the first ramp into the at least one notch.

27. The lighter according to claim 26 wherein the applied force moves the first member toward the second member.

28. The lighter according to claim 27 wherein the second member defines at least one second ramp, so that when the first member is moved toward the second member, the at least one lug rides on the second ramp until the plexor is released from the at least one notch.

29. The lighter according to claim 28 further comprises an impact pad disposed between the piezoelectric element and the plexor.

30. The lighter according to claim 29 further comprises an anvil member and two electrodes, said electrodes define a gap therebetween, such that the spark generated by the impact between the plexor and the piezoelectric element is conducted to the electrodes and discharged from one electrode to the other.

31. The lighter according to claim 22 wherein the latch member is received in a channel defined in the push-button where the external force is applied.

32. The lighter according to claim 22 wherein the latch member is received in a channel defined in the lighter body.

33. The lighter according to claim 22 wherein the latch member returns to the rest configuration after the spark is produced.

* * * * *

UNITED STATES PATENT AND TRADEMARK OFFICE

CERTIFICATE OF CORRECTION

PATENT NO. : 6,046,528
DATED : April 4, 2000
INVENTOR(S) : LaForest et al.

It is certified that error appears in the above-identified patent and that said Letters Patent is hereby corrected as shown below:

Column 8,
Line 8-34, delete all references to "piezoelectric system" and insert therefor
-- piezoelectric element --

Signed and Sealed this

Second Day of July, 2002

*Attest:*

*Attesting Officer*

JAMES E. ROGAN
*Director of the United States Patent and Trademark Office*